US011236455B2

(12) United States Patent
Ohyagi et al.

(10) Patent No.: US 11,236,455 B2
(45) Date of Patent: Feb. 1, 2022

(54) WASHING MACHINE AND METHOD FOR CONTROLLING SAME

(71) Applicant: Samsung Electronics Co., Ltd, Suwon-si (KR)

(72) Inventors: Atsushi Ohyagi, Kanagawa (JP); Nobuhiko Shinohara, Kanagawa (JP); Minsu Kim, Kanagawa (JP); Hiroki Takita, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 448 days.

(21) Appl. No.: 16/303,129

(22) PCT Filed: Dec. 21, 2016

(86) PCT No.: PCT/KR2016/015021
§ 371 (c)(1),
(2) Date: Nov. 19, 2018

(87) PCT Pub. No.: WO2017/111465
PCT Pub. Date: Jun. 29, 2017

(65) Prior Publication Data

US 2020/0308749 A1 Oct. 1, 2020

(30) Foreign Application Priority Data

Dec. 25, 2015 (JP) ..... 2015-255273
Mar. 24, 2016 (JP) ..... 2016-059468
Nov. 22, 2016 (JP) ..... JP2016-226899

(51) Int. Cl.
*D06F 33/00* (2020.01)
*D06F 37/30* (2020.01)
(Continued)

(52) U.S. Cl.
CPC ..... *D06F 33/48* (2020.02); *D06F 34/16* (2020.02); *D06F 39/087* (2013.01); *D06F 2103/18* (2020.02); *D06F 2103/26* (2020.02)

(58) Field of Classification Search
CPC ..... D06F 33/00; D06F 37/304; D06F 37/24; D06F 39/083; D06F 39/087; D06F 39/088; D06F 37/203
See application file for complete search history.

(56) References Cited

U.S. PATENT DOCUMENTS

2014/0082959 A1 3/2014 Oh et al.
2014/0091662 A1* 4/2014 Kim ..... H02K 7/14 310/114
2015/0252507 A1 9/2015 Kim et al.

FOREIGN PATENT DOCUMENTS

CN 104088119 A * 10/2014
JP 2000-042288 A 2/2000
(Continued)

OTHER PUBLICATIONS

International Search Report dated Mar. 31, 2017 in connection with International Patent Application No. PCT/KR2016/015021, 2 pages.
Written Opinion of the International Searching Authority dated Mar. 31, 2017 in connection with International Patent Application No. PCT/KR2016/015021, 2 pages.
(Continued)

*Primary Examiner* — Michael E Barr
*Assistant Examiner* — Pallavi Chitta

(57) ABSTRACT

A control unit comprises a calculation unit, a determination unit, and a motor rotation control unit. The calculation unit calculates the rate of change in water level, which indicates the amount of change in water level per a predetermined period of time, on the basis of the result of sensing by a water level sensor in connection with a water supply stroke. The determination unit determines whether laundry having a waterproof property is contained in a drum or not on the basis of the rate of change in water level during the water supply stroke calculated by the calculation unit. When it is
(Continued)

determined that laundry having a waterproof property is contained in the drum, the motor rotation control unit controls the operation of a driving motor such that the drum is rotated at a predetermined number of rotations or less during the dewatering stroke.

10 Claims, 11 Drawing Sheets

(51) Int. Cl.

| | |
|---|---|
| ***D06F 33/48*** | (2020.01) |
| *D06F 39/08* | (2006.01) |
| *D06F 103/18* | (2020.01) |
| *D06F 103/26* | (2020.01) |
| *D06F 34/16* | (2020.01) |

(56) References Cited

FOREIGN PATENT DOCUMENTS

| | | | | | |
|---|---|---|---|---|---|
| JP | 2000042288 | A | * | 2/2000 | |
| JP | 2001-104680 | A | | 4/2001 | |
| JP | 2001104680 | A | * | 4/2001 | |
| JP | 2015-112316 | A | | 6/2015 | |
| KR | 10-1996-0010961 | A | | 4/1996 | |
| KR | 10-2014-0079258 | A | | 6/2014 | |
| WO | WO-2012114716 | A1 | * | 8/2012 | ..... D06F 33/48 |

OTHER PUBLICATIONS

European Patent Office, "Supplementary European Search Report," Application No. EP16879332.1, Nov. 30, 2018, 8 pages.

Communication pursuant to Article 94(3) EPC dated Sep. 27, 2021 in connection with European Patent Application No. 16 879 332.1, 4 pages.

* cited by examiner

【Fig. 1】
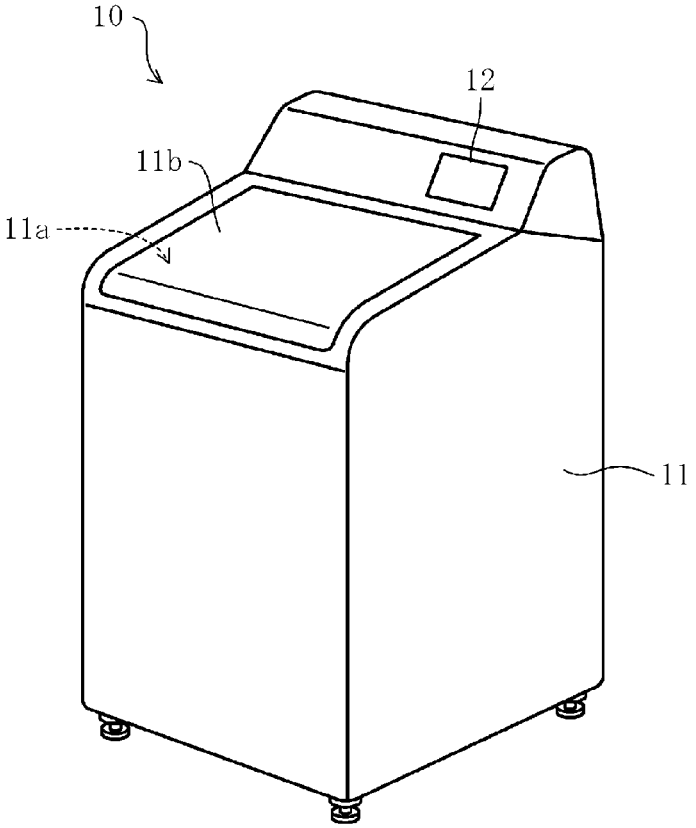

【Fig. 2】
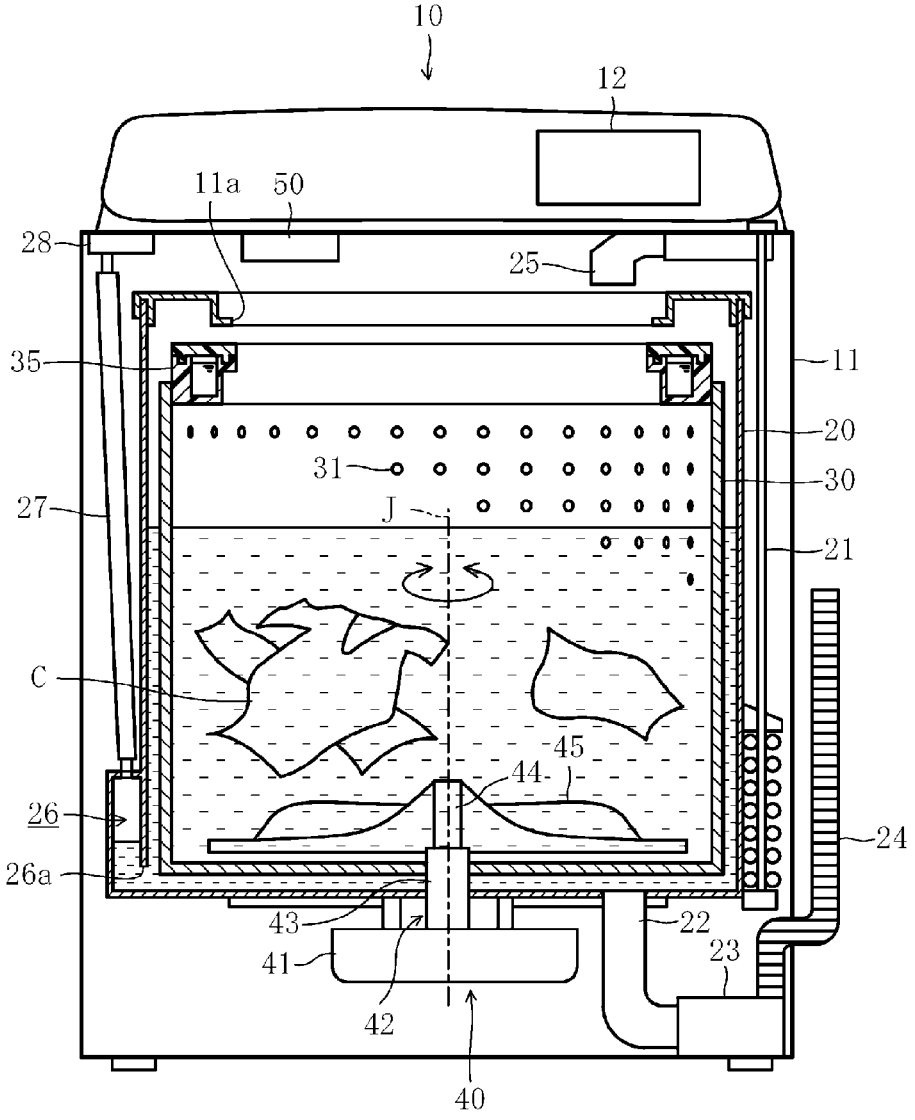

【Fig. 3】
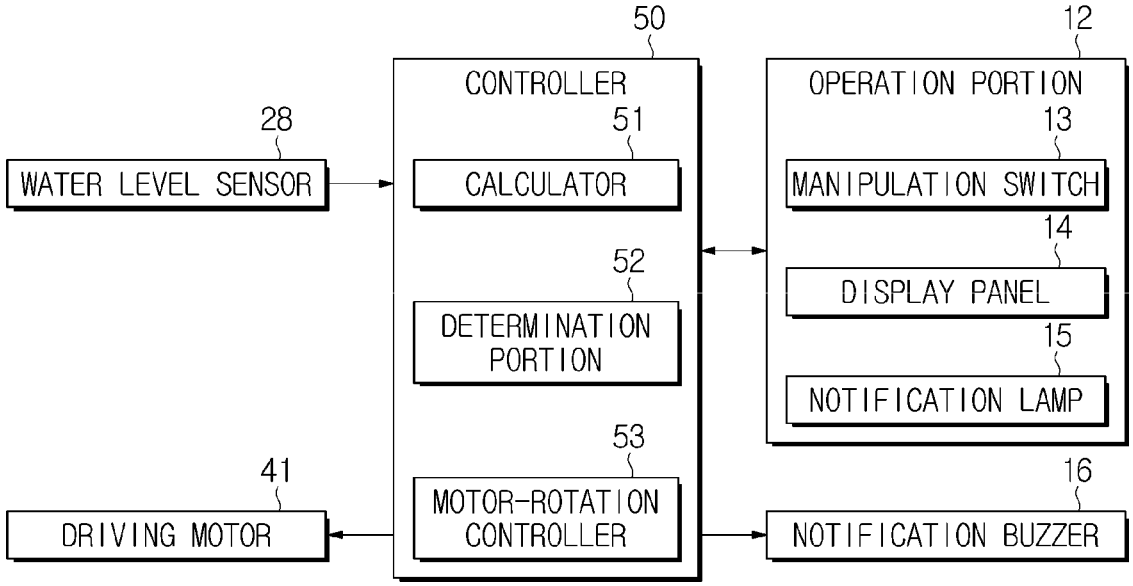

【Fig. 4】
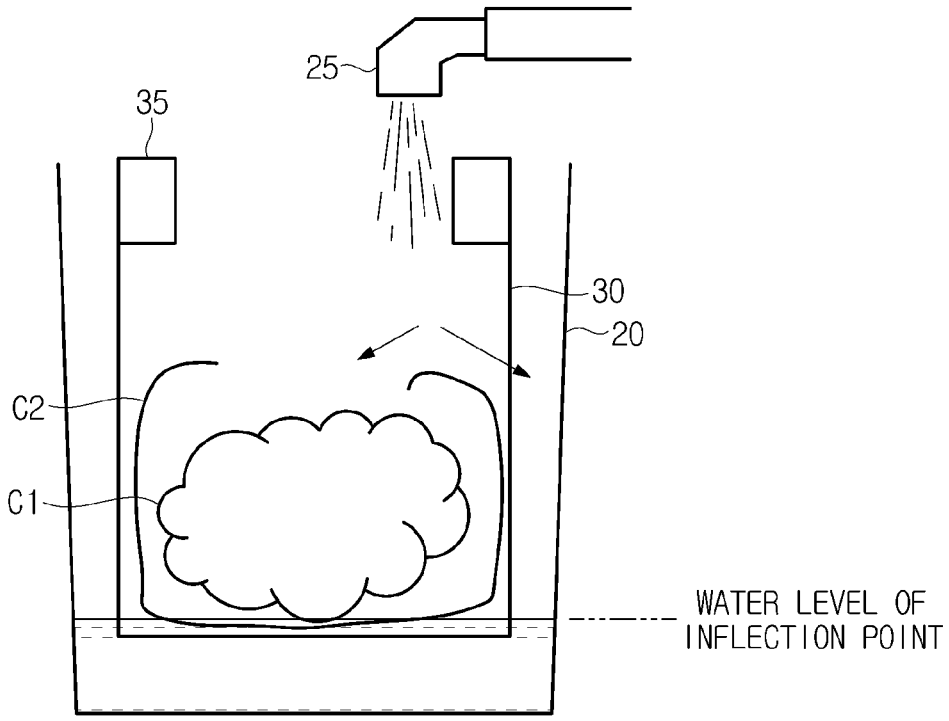

【Fig. 5】
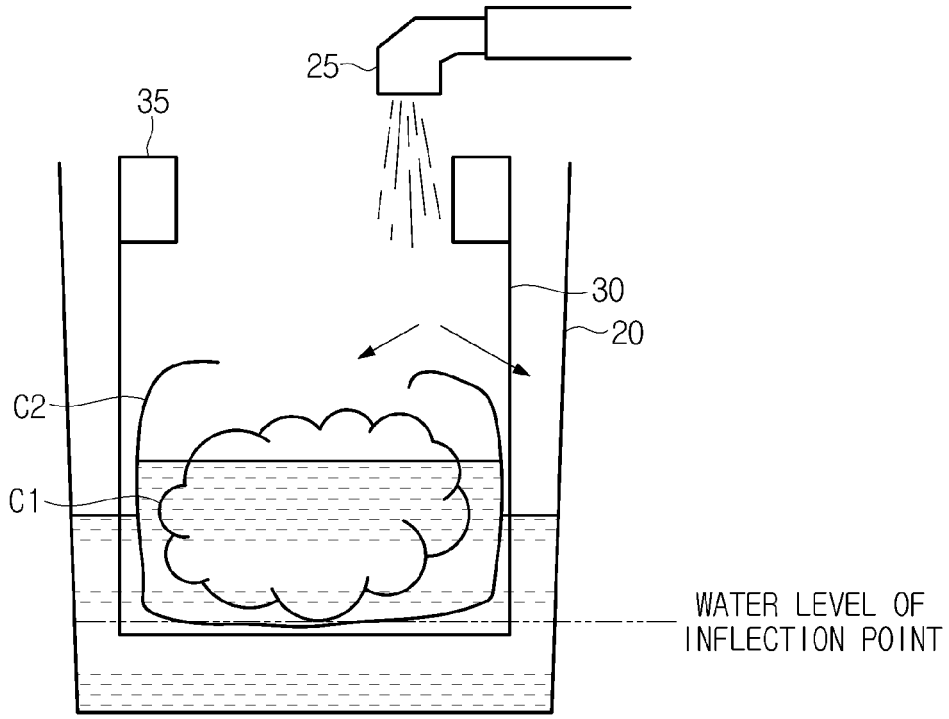

【Fig. 6】
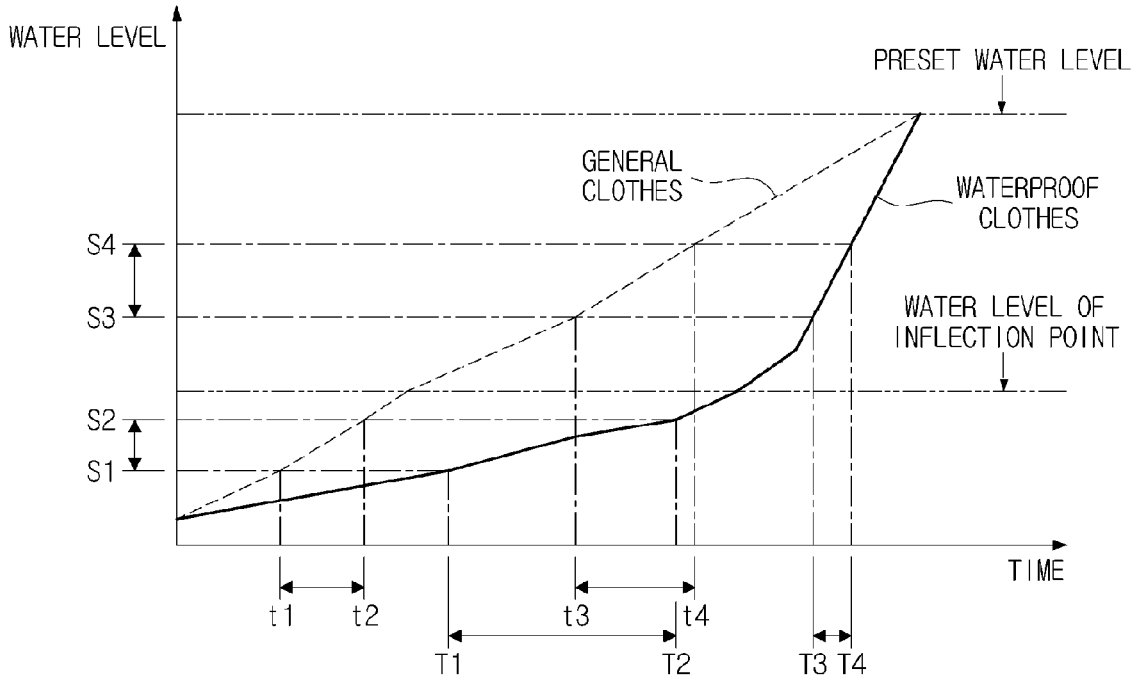

【Fig. 7】
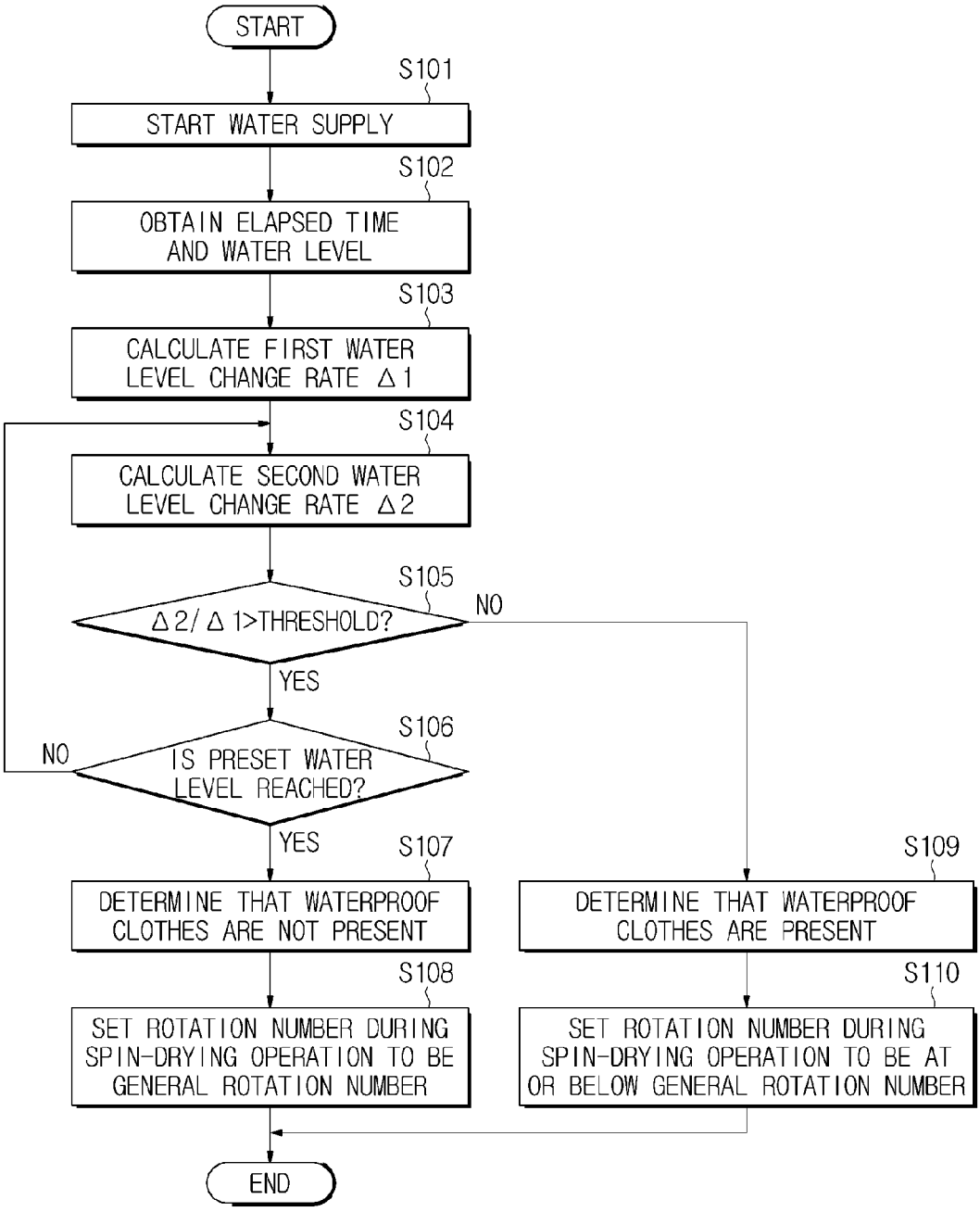

【Fig. 8】
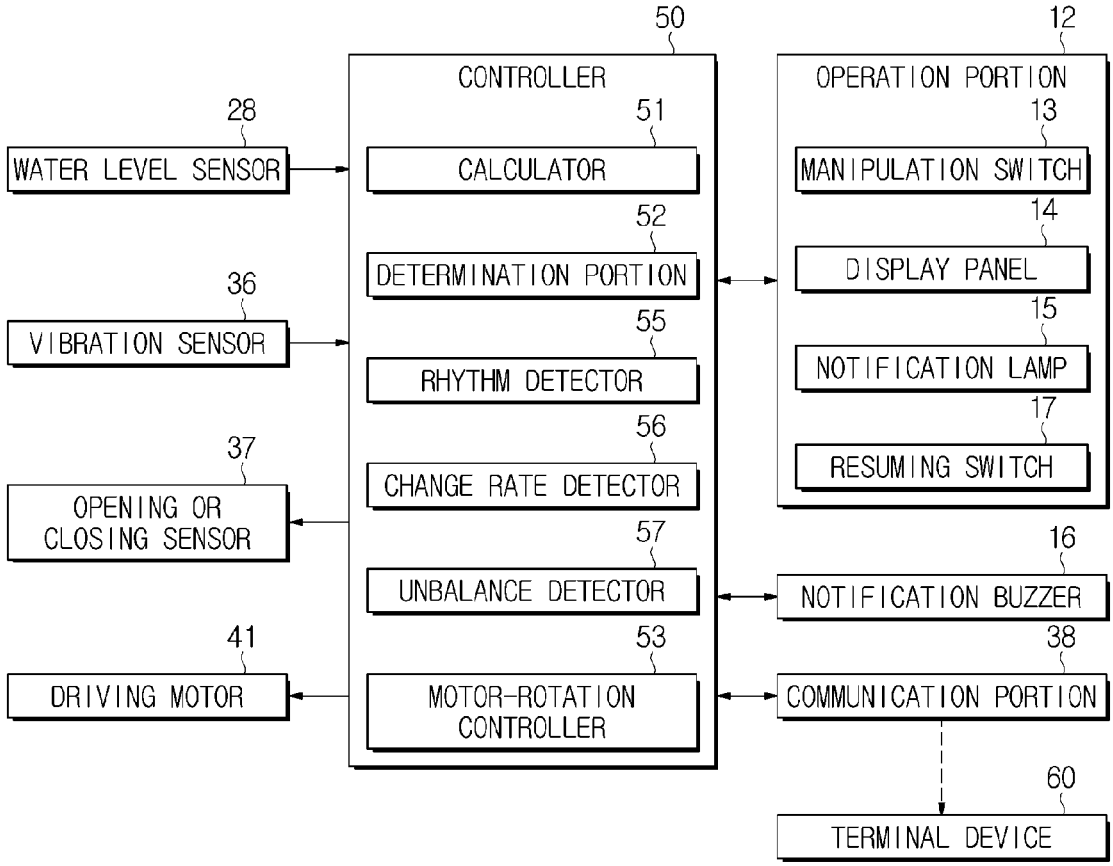

【Fig. 9】
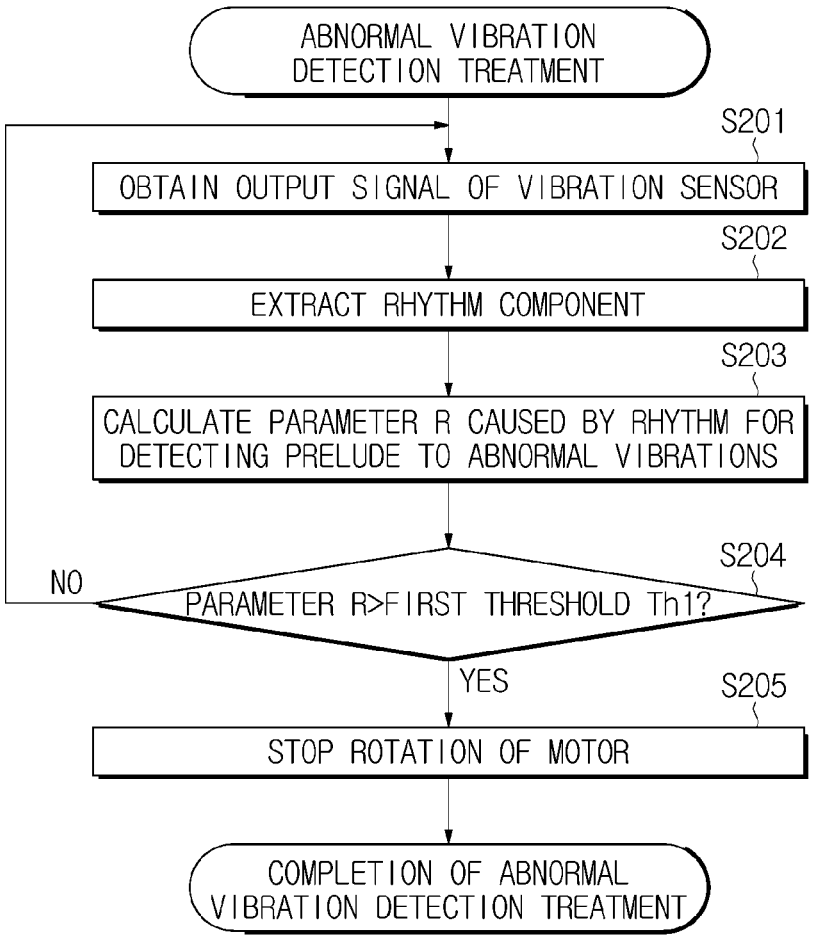

【Fig. 10】
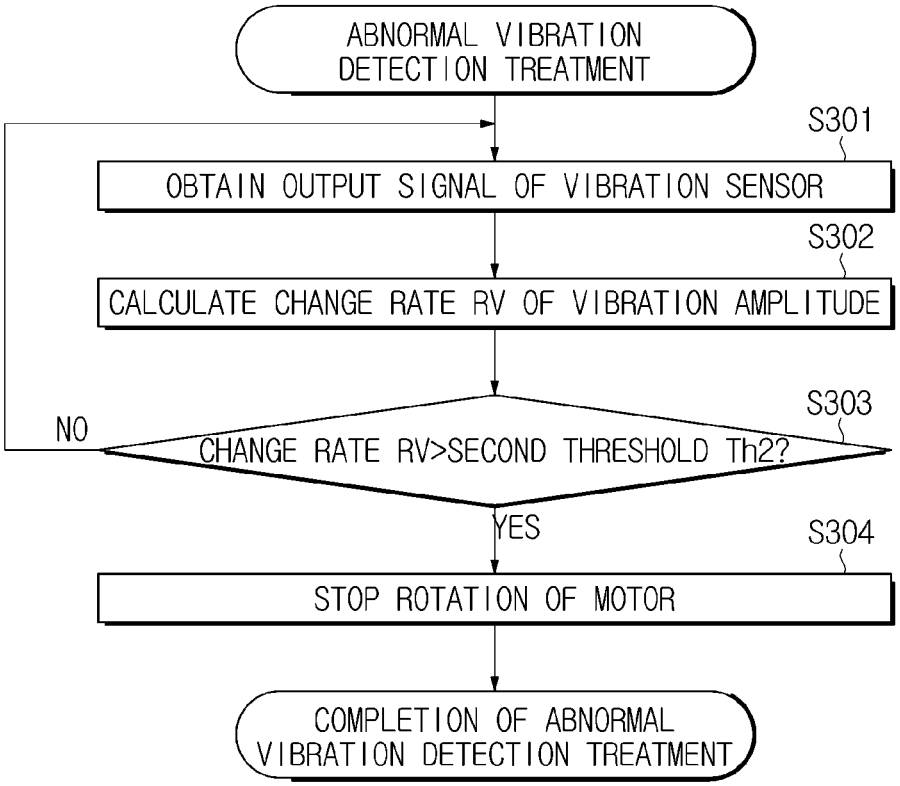

[Fig. 11]
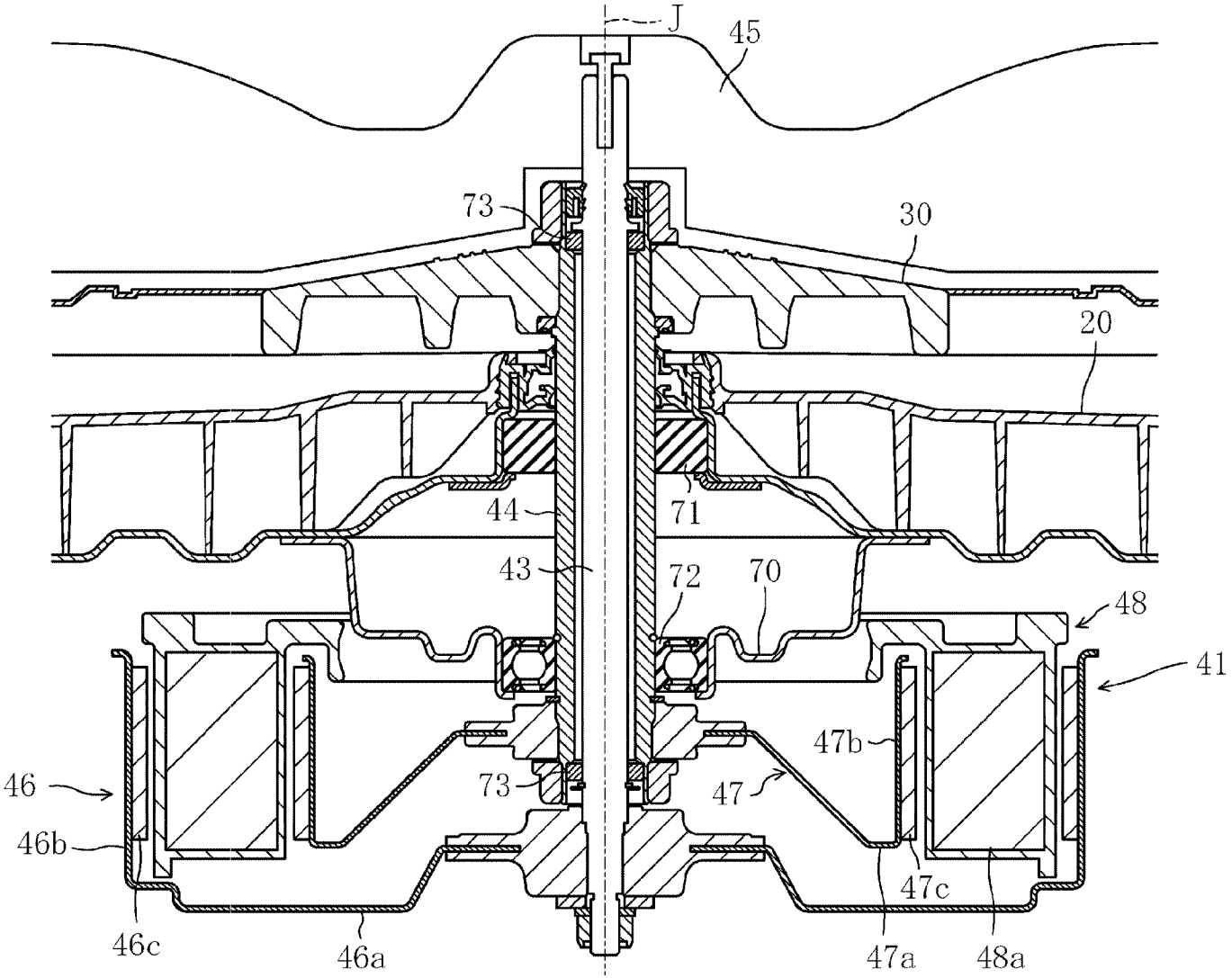

WASHING MACHINE AND METHOD FOR CONTROLLING SAME

CROSS-REFERENCE TO RELATED APPLICATIONS

This application is a 371 of International Application No. PCT/KR2016/015021 filed on Dec. 21, 2016, which claims priority to Japanese Patent Application No. 2015-255273 filed on Dec. 25, 2015, Japanese Patent Application No. 2016-059468 filed on Mar. 24, 2016, and Japanese Patent Application No. 2016-226899 filed on Nov. 22, 2016, the disclosures of which are herein incorporated by reference in their entirety.

BACKGROUND

1. Field

The present invention relates to a washing machine which controls such that abnormal vibrations do not occur during a spin-drying operation and a method of controlling the same.

2. Description of Related Art

Generally, a washing machine (for example, a fully automatic washing machine) is an apparatus which includes an outer tub (hereinafter, referred to as 'a tub') for storing water (wash water or rinse water), a washing and spin-drying tub (hereinafter, referred to as 'a drum') which is rotatably installed in the tub and accommodates laundry, a pulsator which is rotatably installed in the drum and generates a water current, and a motor which generates a driving force for rotating the drum and the pulsator, thus removing contamination of laundry using the water current and a surfactant action of a detergent.

The washing machine performs washing through a series of operations such as a washing operation of separating contamination from laundry using water (in detail, wash water) in which a detergent is dissolved, a rinsing operation of rinsing bubbles or a residual detergent from the laundry with water (in detail, rinse water) which does not include a detergent, and a spin-drying operation of removing water contained in the laundry using high-speed rotation.

The washing machine which performs washing through the series of operations is configured to pressurize the laundry to an inner circumferential surface of the drum using a centrifugal force such that water in the drum or the water contained in the laundry is discharged from the drum through dehydrating holes when the drum rotates at high speed during the spin-drying operation.

However, when laundry having a waterproofing property such as waterproof bedding, a nylon cover, a raincoat, or the like is included, water remains in waterproof laundry or the waterproof laundry is attached to the inner circumferential surface of the drum and obstructs dehydrating holes during the washing operation or the rinsing operation such that the water may not completely drain during the drainage operation.

When the spin-drying operation is started in this state and a rotating speed of the drum reaches 1000 revolutions per minute (rpm) or more, the water which remains in the waterproof laundry moves such that abnormal vibrations occur and the tub rocks and moves significantly.

Accordingly, a variety of considerations have been given for dealing with the vibrations which occur during the spin-drying operation.

For example, in Patent Document 1 (Japanese Patent Publication No. Hei 6-98989) and Patent Document 2 (Japanese Patent Publication No. 2001-104680), when a time necessary for a drainage during a drainage operation is measured and the measured time is shorter than a certain period of time, it is determined that laundry having a waterproofing property is accommodated and water does not completely drain, and an operation of detaching laundry attached to an inner circumferential surface of a drum is performed or an operation of a washing machine is stopped when it is impossible to avoid abnormal vibrations.

SUMMARY

However, it is impossible by only measuring a drainage time like the inventions of Patent Documents 1 and 2 to accurately determine whether waterproof clothes are present.

In detail, a time necessary for drainage varies according to an unequal distribution, position, or the like of waterproof clothes in a drum. For example, when waterproof clothes contain water, a drainage time is decreased as much as an amount of the contained water. Meanwhile, since drainage is not easily performed when waterproof clothes partially obstruct dehydrating holes, a drainage time is increased by as much as the waterproof clothes obstruct the dehydrating holes.

To solve the above problems, it is an aspect of the present invention to provide a washing machine configured to adequately determine when a prelude to abnormal vibrations is present and adequately controlling to prevent occurrence of abnormal vibrations during a spin-drying operation, and a method of controlling the same.

One aspect of the present invention provides a washing machine, which includes a tub, a drum rotatably installed in the tub, a water supply portion configured to supply water to the tub, a driving portion configured to rotate the drum, and a controller configured to control the water supply portion and the driving portion to perform washing operations including a water supply operation, a drainage operation, a spin-drying operation, includes a water level detector configured to detect a water level in the tub, a calculator configured to calculate a water level change rate which indicates a water level change amount per a certain period time according to a detection result of the water level detector during the water supply operation or the drainage operation, and a determination portion configured to determine whether a prelude to abnormal vibrations is present according to the water level change rate during the water supply operation or the drainage operation. Here, the controller controls an operation of the driving portion according to a determination result of the determination portion.

It is determined according to a water level change amount, that is, a water level change rate per a certain period of time during the water supply operation or the drainage operation whether the prelude of abnormal vibration is present. In detail, whether laundry having a waterproofing property is present. Hereinafter, the water supply operation will be described.

In detail, when laundry does not include waterproof clothes and includes only general clothes, when a certain flow rate of water supply is started, a water level increases at an approximate constant speed and reaches a preset water level, a water level change rate becomes approximately constant.

Meanwhile, when laundry includes waterproof clothes, since a space capacity of the drum is divided by the waterproof clothes and reduced, a certain flow rate of water supply is started, a water level increases at an approximate constant speed, and water reaches a position at which the space capacity of the drum is reduced such that a water level change rate rapidly increases. That is, when the waterproof clothes are included in the laundry, an inflection point, at which the water level change rate rapidly increases, is present.

Accordingly, in the present invention, in consideration of the presence of the inflection point, when a ratio between a first water level change rate in which a water level increases by an approximate constant speed before the inflection point and a second water level change rate in which the water level rapidly increases after the inflection point is greater than a certain threshold, it is determined that the prelude to abnormal vibrations is present, that is, waterproof clothes are included in laundry.

Also, the operation of the driving portion is adequately controlled according to a determination result of the determination portion such that occurrence of abnormal vibrations during the spin-drying operation, which is caused by water contained in the waterproof clothes, may be prevented.

When the determination portion determines that the prelude to abnormal vibrations is present, the controller may control the operation of the driving portion to rotate the drum at or below a certain rotation number during the spin-drying operation or control the operation of the driving portion to be stopped.

When it is determined that laundry having a waterproofing property is accommodated in the drum and the prelude to abnormal vibrations is present, the drum may be rotated at or below the certain rotation number during the spin-drying operation. In detail, when a maximum rotation number of the drum in a general spin-drying operation is set to be 1000 revolutions per minute (rpm), when it is determined that the laundry having a waterproofing property is accommodated in the drum, a maximum rotation number of the drum during the spin-drying operation may be set to be, for example, 300 rpm.

Accordingly, the spin-drying operation may be completed without stopping the operation of the washing machine while the occurrence of abnormal oscillation during the spin-drying operation, which may be caused by water held by the waterproof clothes C2, is prevented.

When it is determined that the laundry having a waterproofing property is accommodated in the drum and the prelude to abnormal vibrations is present, the following washing operation may be stopped. Accordingly, the occurrence of abnormal vibrations during the spin-drying operation, which is caused by the water contained in the waterproof clothes, may be prevented.

The calculator may calculate a water change rate in which a water level in the tub rapidly increases according to the space capacity of the drum which is divided by the waterproof clothes accommodated in the drum.

The laundry having a waterproofing property is accommodated in the drum and the space capacity of the drum is divided by the waterproof clothes such that the water level in the tub rapidly increases. That is, when the waterproof clothes are included in the laundry, an inflection point, at which the water level change rate rapidly increases, may be present.

The calculator may calculate the water level change rate at least two times at different times during the water supply operation or the drainage operation.

The water level change rate is calculated two or more times at different times during the water supply operation or the drainage operation.

The determination portion may determine whether the prelude to abnormal vibrations is present according to a ratio between the two water level change rates calculated at different times by the calculator.

It is determined according to the ratio between the two water level change rates calculated at different times whether the prelude of abnormal vibration is present (in detail, whether the laundry having a waterproofing property is present).

The calculator may calculate the water level change rate at least one time when the water level is between a bottom portion of the tub and a bottom portion of the drum or in an area adjacent thereto.

When the water level is between the bottom portion of the tub and the bottom portion of the drum or in the area adjacent thereto, the water level change rate is calculated at least one time. Accordingly, a water level change rate before the inflection point and a water level change rate after the inflection point may be obtained.

The washing machine may further include a notification portion configured to perform a certain notification operation when the determination portion determines that the prelude to abnormal vibrations is present.

When it is determined that the laundry having a waterproofing property is accommodated in the drum and the prelude to abnormal vibrations is present, the notification portion performs the certain notification operation which indicates content thereof. For example, an error message may be displayed on a display panel or a light emitting diode (LED) may be turned on to provide a visual notification to the outside. Also, a notification buzzer sounds to acoustically notify outside the washing machine. Accordingly, the washing machine is configured to call a user's attention to the washing machine and have a high reliability with respect to safety.

The notification portion may be configured to transmit the determination result of the determination portion to an external terminal device having a communication function.

The determination result of the determination portion is transmitted to the external terminal device. For example, when a message which indicates that the laundry having a waterproofing property is accommodated in the drum is transmitted to a terminal device such as a smart phone, a tablet personal computer (PC), or the like, the user's attention may be called to the washing machine.

Also, the washing machine may further include a vibration sensor configured to detect vibrations of the tub. Here, when operations from the water supply operation to the spin-drying operation are sequentially performed, the controller may control the operation of the driving portion according to the determination result of the determination portion. When the washing operation is temporarily stopped during one of the operations from the water supply operation to the spin-drying operation, the operation of the driving portion may be controlled by detecting the prelude to abnormal vibrations using the vibration sensor during the spin-drying operation after resuming the washing operation.

According to whether the washing operation is temporarily stopped during one of the operations from the water supply operation to the spin-drying operation, it is determined which one of the determination result of the determination portion and a detection result of the vibration sensor the operation of the driving portion is determined on the basis of.

In detail, when the operations from the water supply operation to the spin-drying operation are sequentially performed, the operation of the driving portion may be controlled according to the determination result of the determination portion. However, for example, when the water supply operation is temporarily stopped, the water level change rate may not be precisely calculated. Accordingly, when the washing operation is temporarily stopped, the operation of the driving operation may be controlled according to the detection result of the vibration sensor.

The washing machine may further include a cover configured to open or close an inlet through which laundry is inserted or withdrawn, an opening or closing detector configured to detect an opened or closed state of the cover, and a resuming switch configured to resume the washing operation according to a manipulation of a user while the washing operation is stopped. Here, when the opening or closing detector detects that the cover is opened and then closed and the resuming switch is manipulated, the controller may control the operation of the driving portion to rotate the drum at a general rotation number during the spin-drying operation.

When it is determined that the laundry having a waterproofing property is accommodated in the drum, the washing operation is stopped. Also, while the washing operation is stopped, when the user opens and then closes the cover and manipulates the resuming switch, it may be determined that the user removes water contained in waterproof clothes and the drum may be rotated at the general rotation number during the spin-drying operation. Accordingly, even when the drum is rotated at the general rotation number in the spin-drying operation, the occurrence of abnormal vibrations may be prevented.

The washing machine may further include a pulsator connected to the driving portion and configured to stir laundry. Here, when the determination portion determines that the prelude to abnormal vibrations is present, the controller may control the operation of the driving portion to rotate the pulsator at or above a certain rotation number during the washing operation or the rinsing operation preformed after the water supply operation.

When it is determined that the laundry having a waterproofing property is accommodated in the drum and the prelude to abnormal vibrations is present, the pulsator may be rotated at or above the certain rotation number during the washing operation or the rinsing operation. Accordingly, water contained in waterproof clothes is removed by high-speed rotation of the pulsator such that the occurrence of abnormal vibrations may be prevented even when the drum is rotated at the general rotation number during the spin-drying operation.

The driving portion may include a ring-shaped stator and a first rotor and a second rotor independently rotatable from the stator. One of the first rotor and the second rotor may be connected to the drum, and the other of the first rotor and the second rotor may be connected to the pulsator.

The driving portion may be configured as a dual-rotor motor which includes a first rotor and a second rotor independently rotatable from a stator. Accordingly, the water contained in the waterproof clothes may be more easily removed by independently rotating the drum and the pulsator.

The washing machine may further include a vibration sensor configured to detect vibrations of the tub. Here, the controller may detect a prelude to abnormal vibrations using the vibration sensor to control the operation of the driving portion.

The pulsator may be rotated at or above the certain rotation number during the washing operation or the rinsing operation, and the prelude of abnormal vibration may be detected by the vibration sensor during the spin-drying operation. Accordingly, even when the water contained in the waterproof clothes is not completely removed by only rotating the pulsator at high speed, the occurrence of abnormal vibrations may be prevented by adequately controlling the operation of the driving portion according to a detection result of the vibration sensor.

According to a washing machine and a method of controlling the same, it may be adequately determined on the basis of a water level change rate during a water supply operation or a drainage operation whether a prelude to abnormal vibrations is present. Also, when it is determined that waterproof clothes are accommodated in a drum and the prelude to abnormal vibrations is present, occurrence of abnormal vibrations may be prevented during a spin-drying operation by adequately controlling an operation of a driving portion.

BRIEF DESCRIPTION OF THE DRAWINGS

FIG. 1 is a perspective view illustrating the entire configuration of a washing machine according to Embodiment 1 of the present invention.

FIG. 2 is a longitudinal cross-sectional view illustrating the entire configuration of the washing machine.

FIG. 3 is a block diagram illustrating a control operation of the washing machine.

FIG. 4 is a schematic cross-sectional view illustrating a change in a water level before exceeding a water level of an inflection point during a water supply operation.

FIG. 5 is a schematic cross-sectional view illustrating a change in a water level after exceeding the water level of the inflection point during the water supply operation.

FIG. 6 is a graph illustrating a water level change rate of general clothes and a water level change rate of waterproof clothes.

FIG. 7 is a flowchart for determining whether waterproof clothes are present.

FIG. 8 is a block diagram illustrating a control operation of a washing machine according to Embodiment 2 of the present invention.

FIG. 9 is a flowchart illustrating a detection of a prelude to abnormal vibrations based on a rhythmic component.

FIG. 10 is a flowchart illustrating a detection of a prelude to abnormal vibrations based on vibration amplitude.

FIG. 11 is a side cross-sectional view illustrating a configuration of a driving motor mounted on a washing machine according to Embodiment 3 of the present invention.

DETAILED DESCRIPTION

Embodiments described herein and configurations shown in the drawings are merely exemplary embodiments. Also, various modified examples with which these embodiments and the drawings could be replaced may be present at the time of filing of the present application.

Also, the terms used herein explain the embodiments but are not intended to restrict and/or limit the present invention. Singular expressions, unless clearly defined otherwise in context, include plural expressions. Throughout the specification, the terms "comprise," "include," "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as "first", "second", and the like may be used to describe various components, the components are not be limited by the terms and the terms are used only for distinguishing one element from others. For example, without departing from the scope of the present disclosure, a first component may be referred to as a second component, and similarly, a second component may be referred to as a first component. The term "and/or" includes any and all combinations of one or a plurality of associated listed items.

First Embodiment

FIG. 1 is a perspective view illustrating the entire configuration of a washing machine according to Embodiment 1 of the present invention, and FIG. 2 is a longitudinal cross-sectional view illustrating the entire configuration of the washing machine.

In FIGS. 1 and 2, a washing machine 10 according to an embodiment of the present invention includes a rectangular box-shaped case 11. An operation portion 12 for allowing a user to operate the washing machine is formed at a top of the case 11. The operation portion 12 includes an operation switch 13, a display panel 14, and a light emitting diode (LED) 15 (refer to FIG. 3). The washing machine 10 may automatically perform each of "water supplying," "washing,", "rinsing," and "spin-drying" in a row by operating the operation switch 13.

In the case 11, an outer water tub (hereinafter, referred to as "a tub") 20, an inner water tub (hereinafter, referred to as "a drum") 30, a driving device 40, a pulsator 45, a balancer 35, and the like are installed.

The tub 20 is configured to be an upwardly open cylindrical container having a bottom and is installed at a central portion of the case 11. The tub 20 is suspended and supported by the case 11 through a plurality of suspensions 21 to freely rotate in the case 11.

The drum 30 is configured to be an upwardly open cylindrical container having a bottom such that laundry C is inserted into and withdrawn from an inlet 11*a* in an upward direction. The inlet 11*a* is configured to be opened and closed by a cover 11*b*. The drum 30 is configured to be a container smaller than the tub 20 by one step and is rotatably installed in the tub 20. In detail, the drum 30 is accommodated in the tub 20 while both centers thereof coincide with a longitudinal axis J in the tub 20 and rotates around the longitudinal axis J, which stretches in an approximately vertical direction, due to driving of the driving device 40.

A plurality of dehydrating holes 31 are formed throughout an entire circumference of and pass through both an inside and an outside of a peripheral wall portion of the drum 30.

The driving device 40 is installed at the bottom of the tub 20. The driving device 40 includes a driving motor 41 and a power transmission device 42. The power transmission device 42 includes a first rotating shaft 43 and a second rotating shaft 44 located in the center of the tub 20. The first rotating shaft 43 passes through a bottom portion of the tub 20 and is mounted on the drum 30. The second rotating shaft 44 passes through the bottom portion of the tub 20 and a bottom portion of the drum 30 and protrudes into the inside of the drum 30 to be mounted in the pulsator 45.

The power transmission device 42 independently or integrally rotates the first rotating shaft 43 and the second rotating shaft 44 in a forward and backward direction due to driving of the driving motor 41 while switching according to each operation. For example, in the washing operation or rinsing operation, the second rotating shaft 44 is driven and the pulsator 45 forwardly and backwardly rotates in a constant cycle. During the spin-drying operation, the first rotating shaft 43 is driven such that the drum 30 rotates at high speed.

A drain hose 22 is connected to the bottom portion of the tub 20. A drain pump 23 is connected to the drain hose 22. A machine exterior hose 24 installed outside the case 11 is connected to the drain pump 23. The drain pump 23 performs a drainage corresponding to each operation. A water supply device 25 which supplies water to the tub 20 corresponding to each operation is installed at a position above the tub 20.

Also, an airtight chamber 26 is installed around the tub 20 as a whole. The airtight chamber 26 is installed at a lower position of an outer circumferential wall of the tub 20 and communicates with the tub 20 through a communication hole 26*a*. A sub hose 27 is connected to a top of the airtight chamber 26. A water level sensor (a water level detector) 28 which detects a water level of the tub 20 is connected to the sub hose 27. The water level sensor 28 is formed in the top of the case 11.

Also, when water is supplied to the tub 20 from the water supply device 25, some water also flows into the airtight chamber 26 through the communication hole 26*a*. As the water level of the tub 20 gradually increases, air pressure in the airtight chamber 26, which communicates with the tub 20, gradually increases. Since the airtight chamber 26 and the water level sensor 28 are air-tightly connected through the sub hose 27, the water level sensor 28 outputs a vibration frequency according to a change of the air pressure.

Here, for example, during the washing operation or the rinsing operation, water is supplied to the drum 30 from the water supply device 25 while the drain pump 23 is stopped, and then the water is stored in the tub 20 and the drum 30. As the pulsator 45 rotates in this state, the laundry C is stirred with the water such that the washing operation or the rinsing operation is performed.

Also, in an intermediate spin-drying operation or the spin-drying operation, the drum 30 is rotated at high speed while the drain pump 23 is operated. As a result thereof, water contained in the laundry C is discharged from the drum 30 through the dehydrating holes 31 due to an effect of centrifugal force. The water discharged from the drum 30 is drained outside the tub 20 and the drum 30 of the washing machine 10 through the drain hose 22 and the machine exterior hose 24.

The balancer 35 is installed at an upward opening portion of the drum 30. The balancer 35 is a circular-ring-shaped member filled with a hyperbaric liquid such as salt water or the like. The balancer 35 is installed to suppress vibration by adjusting a weight imbalance caused by unequal distribution of the laundry C during rotation of the drum 30. However, the balancer 35 is not limited to a fluid balancer and may also be a ball balancer.

The driving device 40 is controlled by a controller 50 installed at the top of the case 11. The controller 50 includes a central processing unit (CPU), a read-only memory (ROM), and the like and the CPU reads and executes a control program previously recorded in the ROM such that the water supply operation, the washing operation, the intermediate spin-drying operation, the rinsing operation, a drainage operation, and the spin-drying operation are sequentially performed.

However, since most of the water in the drum 30 is drained through the dehydrating holes 31 and the like, a large amount of water does not remain in the drum 30 during the spin-drying operation. However, when clothes and the like, which do not transmit water, such as waterproof bedding, a nylon cover, a rain coat, and the like are washed, the laundry C having a waterproofing property sometimes spreads such that a large amount of water is held in the drum 30 after the rinsing operation is finished.

In this state, when the water contained in the laundry C having a waterproofing property quickly moves in the spin-drying operation, the fluid of the balancer 35 cannot follow an unbalanced load such that the washing machine 10 abnormally vibrates.

Accordingly, in the embodiment, abnormal vibration caused by the laundry C having a waterproofing property such as waterproof bedding and the like may be prevented. In detail, this effect will be described with reference to FIG. 3.

FIG. 3 is a block diagram illustrating a control operation of the washing machine.

In FIG. 3, the driving motor 41, the water level sensor 28, the operation portion 12, and the like are connected to the controller 50. The controller 50 includes a variety of software means embodied by the CPU executing the control program corresponding to each operation input by the operation portion 12.

That is, the controller 50 includes a calculator 51 which calculates a water level change rate which indicates a change rate of a water level per a certain period of time on the basis of a detection result of the water level sensor 28 in the water supply operation, a determination portion 52 which determines whether the laundry C having a waterproofing property is accommodated in the drum 30 on the basis of the water level change rate in the water supply operation, calculated by the calculator 51, and a motor-rotation controller 53 which controls rotation of the driving motor 41. Also, the controller 50 controls operations of the drain pump 23, the water supply device 25, and the like corresponding to each operation.

Hereinafter, it will be described how to determine whether a prelude of abnormal vibration is present, that is, whether the laundry C having a waterproofing property is present. Also, hereinafter, laundry without waterproofing property is referred to as general clothes C1 and laundry having a waterproofing property is referred to as waterproof clothes C2.

FIG. 4 is a schematic cross-sectional view illustrating a change in a water level before exceeding a water level of an inflection point during a water supply operation.

In FIG. 4, when water is supplied toward the drum 30 from the water supply device 25, the water passes through the dehydrating holes 31 of the drum 30 and is also stored in the tub 20. FIG. 4 illustrates a state in which the waterproof clothes C2 have a pouch shape with an upward opening and the general clothes C1 is accommodated therein. Here, the water supplied by the water supply device 25 reaches an upward edge portion of the waterproof clothes C2 and flows toward the tub 20 as it is and simultaneously some thereof remains in the waterproof clothes C2.

FIG. 5 is a schematic cross-sectional view illustrating a change in a water level after exceeding the water level of the inflection point during the water supply operation.

Also, as shown in FIG. 5, after the water reaches a position at which space capacity of the drum 30 is reduced by being divided by the waterproof clothes C2, the water level in the tub 20 rapidly increases. That is, when the waterproof clothes C2 are included in the laundry, an inflection point, at which a change rate of the water level rapidly increases, is present.

Hereinafter, a water level of the inflection point will be described with reference to FIG. 6.

FIG. 6 is a graph illustrating a water level change rate of general clothes and a water level change rate of waterproof clothes.

As shown in FIG. 6, when the laundry does not include the waterproof clothes C2 and includes only the general clothes C1, since a certain flow rate of water starts and a water level increases at an approximately uniform speed such that a preset water level is reached, a water level change rate becomes approximately constant.

Also, whether the water level change rate is approximately constant may be determined according to whether a ratio of a first water level change rate $\Delta 1$ calculated after a certain period of time from a start of water supply to a second water level change rate $\Delta 2$ calculated after the first water level change rate $\Delta 1$ is greater than a certain threshold.

Here, the first water level change rate $\Delta 1$ may be calculated using a time t1 which is a time from the start of water supply until reaching a water level S1 and a time t2 which is a time from the start of water supply until reaching a water level S2. That is, $\Delta 1=(S2-S1)/(t2-t1)$.

Also, likewise, the second water level change rate $\Delta 2$ may be calculated using a time t3 which is a time from the start of water supply until reaching a water level S3 and a time t4 which is a time from the start of water supply until reaching a water level S4. That is, $\Delta 2=(S4-S3)/(t4-t3)$.

Also, as known from the graph of FIG. 6, in the case of the general clothes C1, the first water level change rate $\Delta 1$ and the second water level change rate $\Delta 2$ show approximately equal inclines comparing any sections from the start of water supply to preset water levels. Accordingly, since a ratio of the second water level change rate $\Delta 2$ to the first water level change rate $\Delta 1$ is about 1 and smaller than the certain threshold (for example, 3 to 6), the determination portion 52 determines that the waterproof clothes C2 are not included.

Meanwhile, when the waterproof clothes C2 are included in the laundry, a water level increases at an approximately uniform speed after starting a certain amount of water supply, and then a water level change rate rapidly increases at a point in time when exceeding a water level of the inflection point.

Accordingly, the first water level change rate $\Delta 1$ is calculated using a time T1 which is a time from the start of water supply until reaching the water level S1 which is a water level lower than the water level of the inflection point and a time T2 which is a time from the start of water supply until reaching the water level S2. That is, $\Delta 1=(S2-S1)/(T2-T1)$.

Also, likewise, the second water level change rate $\Delta 2$ is calculated using a time T3 which is a time from the start of water supply until reaching the water level S3 which is a water level higher than the water level of the inflection point and a time T4 which is a time from the start of water supply until reaching the water level S4. That is, $\Delta 2=(S4-S3)/(T4-T3)$.

Also, as known from the graph of FIG. 6, in the case of the waterproof clothes C2, the water level change rate rapidly changes before and after the water level of the inflection point. Accordingly, since a ratio of second water level change rate Δ2 to the first water level change rate Δ1 is about 10 and greater than the certain threshold (for example, 3 to 6), the determination portion 52 determines that the waterproof clothes C2 are included.

Also, when it is determined that the waterproof clothes C2 are accommodated in the drum 30, the controller 50 controls rotation of the driving motor 41 to rotate the drum 30 at or below a certain rotation number during the intermediate spin-drying operation or a final spin-drying operation.

In detail, while a maximum rotation number of the drum 30 is set to be 1000 revolutions per minute (rpm) during a general spin-drying operation, when it is determined that the waterproof clothes C2 are accommodated in the drum 30, the maximum rotation number of the drum 30 is set to be, for example, 300 rpm.

Accordingly, the spin-drying operation may be completed without stopping the operation of the washing machine 10 while occurrence of abnormal vibration during the spin-drying operation, caused by water held by the waterproof clothes C2, is prevented Also, as shown in FIG. 3, a notification buzzer (notification portion) 16 is connected to the controller 50. When it is determined by the determination portion 52 that the waterproof clothes C2 are accommodated in the drum 30, the notification buzzer 16 may sound to acoustically report it and may call a user's attention to the washing machine 10. Also, the display panel 14 or the LED 15 is used as a notification portion to display an error message on the display panel 14 or to turn on the LED 15 for a visual report.

FIG. 7 is a flowchart for determining whether waterproof clothes are present.

In FIG. 7, in step S101, water is supplied by the water supply device 25 to the tub 20 while a washing operation is performed. Step S102 is performed.

In step S102, elapsed time T after water supply is started and a water level S in the tub 20 at the elapsed time T are obtained, and step S103 is performed. Also, the elapsed time T and the water level S are sequentially obtained from the start of water supply until reaching a preset water level.

In step S103, a first water level change rate Δ1 is calculated on the basis of a time T1 which is a time from the start of water supply until reaching a certain water level S1 and a time T2 which is a time from the start of water supply until reaching a water level S2. Step S104 is performed. That is, $\Delta 1=(S2-S1)/(T2-T1)$.

In step S104, a second water level change rate Δ2 is calculated on the basis of a time T3 which is a time from the start of water supply until reaching a water level S3 which is higher than the water level S2 and a time T4 which is a time from the start of water supply until reaching a water level S4. Step S105 is performed. That is, $\Delta 2=(S4-S3)/(T4-T3)$.

In step S105, it is determined whether a ratio Δ2/Δ1 of the second water level change rate Δ2 to the first water level change rate Δ1 is greater than a certain threshold. When it is determined to be "YES" in step S105, step S109 is performed. When it is determined to be "NO" in step S105, step S106 is performed.

In step S106, it is determined whether a water level in the drum 30 reaches a preset water level. When it is determined to be "YES" in step S106, step S107 is performed. When it is determined to be "NO" in step S106, step S104 is performed and the second water level change rate Δ2 is calculated again. Also, in the recalculation, the second water level change rate Δ2 is calculated while the water levels S3 and S4 are updated to be higher than those of a previous calculation.

In step S107, it is determined that waterproof clothes C2 are not included in laundry because Δ2/Δ1 does not exceed a certain threshold from the start of water supply to reaching the preset water level. Step S108 is performed.

In step S108, a rotation number of the driving motor 41 is set to rotate the drum 30 at a general rotation number (for example, 1000 rpm) during an intermediate spin-drying operation or a final spin-drying operation and handling is finished.

In step S109, it is determined that waterproof clothes C2 are included in laundry because Δ2/Δ1 is exceeding the certain threshold from the start of water supply to reaching the preset water level. Step S110 is performed.

In step S110, the rotation number of the driving motor 41 is set to rotate the drum at or below a certain rotation number (for example, 300 rpm) during the intermediate spin-drying operation or the final spin-drying operation and handling is finished.

Also, although a water level change rate is calculated during a water supply operation in the embodiment, it is also possible to calculate the water level change rate during a drainage operation. In detail, in the drainage operation, a graph in which a water level decreases with the elapse of time like a reversal of the graph shown in FIG. 6 is shown.

Here, when the waterproof clothes C2 are not included in the laundry and only general clothes C1 are present, since a drainage is started at a certain flow rate while water remains at the preset water level and the water level decreases at an approximate constant speed such that the drainage is completed, the water level change rate is approximately constant.

Meanwhile, when the waterproof clothes C2 are included in the laundry, after the drainage is started at the certain flow rate while water remains at the preset water level, the water level decreases at an approximate constant speed, therefore the water level change rate rapidly decreases at a point in time below a water level of an inflection point.

As described above, also in the drainage operation, since the water level change rate rapidly changes before and after the water level of the inflection point when the waterproof clothes C2 are included in the laundry, the determination portion 52 may determine whether the waterproof clothes C2 are present.

Embodiment 2

FIG. 8 is a block diagram illustrating a control operation of a washing machine according to Embodiment 2 of the present invention. Here, portions like those in Embodiment 1 will be referred to with like reference numerals and only differences therebetween will be described.

In FIG. 8, in addition to the driving motor 41, the water level sensor 28, the operation portion 12, and the notification buzzer 16, a vibration sensor 36, an opening or closing sensor (an opening or closing detector) 37, and a communication portion (a notification portion) 38 are connected to the controller 50.

The vibration sensor 36 is installed at the tub 20 of the washing machine 10 and detects vibration of the tub 20.

The opening or closing sensor 37 detects an opened or closed state of the cover 11*b* and is configured as a proximity sensor or a magnetic sensor. The opening or closing sensor 37 is installed at a circumferential edge portion of the inlet 11*a* of the case 11. A permanent magnet (not shown) is installed in the cover 11*b* at a position corresponding to the opening or closing sensor 37, and the opening or closing sensor 37 and the permanent magnet face each other while the cover 11*b* is closed. Meanwhile, when the cover 11*b* is opened, the permanent magnet is separated from the opening or closing sensor 37. Accordingly, an opened or closed state of the cover 11*b* may be detected by the opening or closing sensor 37.

The communication portion 38 transmits a message, which indicates that laundry C having a waterproofing property is accommodated in the drum 30, to an external terminal device 60 having a communication function. The terminal device 60 may be, for example, a smart phone, a tablet PC, or the like and may call a user's attention to the washing machine 10 by displaying an error message on a display monitor of the terminal device 60.

Here, the controller 50 changes an operation of the driving motor 41 between a drainage operation and a spin-drying operation according to whether a washing operation is temporarily stopped or not. In detail, while operations from a water supply operation to the spin-drying operation are consecutively performed, when the determination portion 52 determines that the waterproof clothes C2 are accommodated in the drum 30 on the basis of a water level change rate, the controller 50 controls rotation of the driving motor 41 to rotate the drum 30 at or below a certain rotation number during an intermediate spin-drying operation or a final spin-drying operation.

However, for example, when the water supply operation is temporarily stopped, it is impossible to precisely calculate the water level change rate. Accordingly, when washing is temporarily stopped during one of the operations from the water supply operation to the spin-drying operation, a prelude of abnormal vibration is detected on the basis of the vibration sensor 36 in the intermediate spin-drying operation or the final spin-drying operation after the washing is resumed. Also, the controller 50 controls the rotation of the driving motor 41 to be stopped, on the basis of a detection result of the vibration sensor 36.

Hereinafter, detection of the prelude of abnormal vibration will be described.

In addition to the calculator 51, the determination portion 52, and the motor-rotation controller 53, the controller 50 includes a rhythm detector 55, a change rate detector 56, and an unbalance detector 57 which detects an unbalanced state of the laundry C in the drum 30.

Here, in the present invention, it was detected by analyzing output of the vibration sensor 36 during operation of the washing machine 10 that a peculiar movement had occurred in an output signal of the vibration sensor 36 before occurrence of abnormal vibration. In detail, it was detected that a parameter caused by a rhythm component of the output signal of the vibration sensor 36, which had a longer cycle than a rotation cycle of the drum 30, particularly increased before occurrence of abnormal vibration.

The rhythm detector 55, which is provided on the basis of the above detection, obtains the output signal of the vibration sensor 36 during the spin-drying operation of the washing machine 10, extracts the rhythm component having the longer cycle than the rotation cycle of the drum 30 from the output signal, calculates a parameter R, which is caused by the rhythm for detecting the prelude of abnormal vibration of the washing machine 10, by executing a certain signal treatment on the rhythm component, and determines that the prelude of abnormal vibration is present when a value of the parameter R exceeds a preset first threshold Th1. Also, the first threshold Th1 is a fixed value. Here, the parameter R, for example, is obtained by factorizing a vibration component obtained by the vibration sensor 36 according to fast Fourier transform (FFT) and the like and calculating intensity of the vibration component of a certain frequency. Also, other values in addition to the intensity are available.

Also, in the present invention, it was detected that amplitude of vibration rapidly changed before the occurrence of abnormal vibration. The change rate detector 56, which is configured on the basis of the above detection, obtains an output signal of the vibration sensor 36, calculates a change rate RV of the amplitude of vibration by executing a certain signal treatment on the output signal, and determines that a prelude of abnormal vibration is present when the change rate RV exceeds a preset second threshold Th2.

The unbalance detector 57 detects an unbalanced state of laundry in the drum 30 using a mechanical switch, an infrared sensor, or the like in addition to the vibration sensor 36.

The motor-rotation controller 53 controls rotation of the driving motor 41 on the basis of a determination result of the unbalance detector 57, a determination result of the rhythm detector 55, and a determination result of the change rate detector 56.

Detection of Prelude of Abnormal Vibration

Next, abnormal vibration prelude detection treatment in which a prelude of abnormal vibration is detected during a spin-drying operation and which is executed by the controller 50 will be described with reference to FIGS. 9 and 10.

FIG. 9 is a flowchart illustrating a detection of a prelude to abnormal vibrations based on a rhythmic component, and FIG. 10 is a flowchart illustrating a detection of a prelude to abnormal vibrations based on vibration amplitude.

<Detection of Prelude Based on Rhythm>

A detection of a prelude to abnormal vibrations based on a rhythm component will be described with reference to FIG. 9. The detection of the prelude to abnormal vibrations is executed during a spin-drying operation after a washing operation and a rinsing operation.

In FIG. 9, in step S201, the controller 50 obtains an output signal which is transmitted from the vibration sensor 36 and indicates a vibration state of the tub 20. Step S202 is performed.

In step S202, a certain signal treatment is executed on the obtained output signal and a rhythm component having a longer cycle than a rotation cycle of the drum 30 is extracted, and step S203 is performed. Here, the controller 50 changes an extracted rhythm component according to a rotation number of the drum 30. That is, as a result of a simulation in which abnormal vibrations were generated while a plastic bag was spread on the entire inner surface of the drum 30 such that a large-sized waterproof cloth was present and unbalance was added and which was executed according to the present invention, a frequency having the highest intensity (a peak frequency) among rhythm components detected before the occurrence of abnormal vibrations increases as a rotation number of the drum 30 increases. That is, a relationship shown as a schematic linear function is present between the rotation number of the drum 30 and the peak frequency of the rhythm component detected just before the occurrence of abnormal vibrations.

In step S203, the controller 50 calculates a parameter R, which is caused by a rhythm for detecting a prelude to abnormal vibrations from the extracted rhythm component, is calculated. Step S204 is performed.

In step S204, it is determined whether a parameter R value is greater than a preset first threshold Th1. When it is determined to be "YES" in step S204, step S205 is performed. When it is determined to be "NO" in step S204, the controller 50 determines that the prelude to abnormal vibrations is not present and gives a feedback to return to step S201.

In step S205, the controller 50 determines that the prelude to abnormal vibrations is present and stops rotation of the driving motor 41 to complete the treatment. Here, the rhythm component detected by the controller 50, which is mainly extracted, has a longer cycle than a rotation cycle of the drum 30.

<Detection of Prelude Based on Change Rate of Vibration Amplitude>

Next, a detection of a prelude to abnormal vibrations based on a change rate of vibration amplitude will be described with reference to FIG. 10. The detection of the prelude to abnormal vibrations is also executed during a spin-drying operation after a washing operation and a rinsing operation.

In FIG. 10, in step S301, the controller 50 obtains an output signal which is transmitted from the vibration sensor 36 and indicates a vibration state of the tub 20. Step S302 is performed.

In step S302, the controller 50 performs a certain signal treatment on the obtained output signal and calculates a change rate RV of vibration amplitude of the tub 20. Step S303 is performed.

In step S303, it is determined whether the calculated change rate RV of vibration amplitude is greater than a preset second threshold Th2. When it is determined to be "YES" in step S303, step S304 is performed. When it is determined to be "NO" in step S303, the controller 50 determines that a prelude to abnormal vibrations is not present and gives a feedback to return to step S301.

In step S304, the controller 50 determines that the prelude to abnormal vibrations is present and stops rotation of the driving motor 41 to complete the treatment.

According to the detection of the prelude to abnormal vibrations, it is determined on the basis of output of the vibration sensor 36 whether the prelude to abnormal vibrations is present in the drum 30. In detail, the certain signal treatment is performed on the output signal of the vibration sensor 36, a rhythm component of one cycle of a certain integer of the rotation cycle of the drum 30 is extracted, a parameter R for detecting the prelude to abnormal vibrations is obtained from the rhythm component, it is determined on the basis of the parameter R whether the prelude to abnormal vibrations is present, and the rotation of the drum 30 is stopped when it is determined that the prelude to abnormal vibrations is present. Accordingly, it is possible to prevent abnormal vibrations.

Also, according to the detection of the prelude to abnormal vibrations, when the change rate RV of vibration amplitude of the tub 20 exceeds the second threshold Th2, it is determined to be the prelude to abnormal vibrations and rotation of the drum 30 is stopped. Accordingly, it is possible to prevent abnormal vibrations. Also, since a rapid change of vibration amplitude and a rhythm component separately occur, it is possible to detect the rhythm component and the prelude to abnormal vibrations with high accuracy.

However, in the embodiment, when it is determined that the prelude to abnormal vibrations is present, the rotation of the drum 30 is stopped. Here, it is possible to call a user's attention to the washing machine 10 by allowing the notification buzzer 16 to sound and transmitting an error message to the terminal device 60, or the like.

Also, a user who knows that a washing operation of the washing machine 10 is stopped may open the cover 11*b* first, remove water contained in waterproof clothes C2, and then close the cover 11*b* to resume the washing operation. An opened or closed state of the cover 11*b* is detected by the opening or closing sensor 37. Also, the user resumes the washing operation by manipulating a resuming switch 17.

While the washing operation is stopped, when the user opens the cover 11*b*, closes the cover 11*b*, and manipulates the resuming switch 17, the controller 50 determines that the user removes water contained in the waterproof clothes C2 and controls driving of the driving motor 41 to rotate the drum 30 at a general rotation number in a spin-drying operation. Accordingly, even when the drum 30 is rotated at the general rotation number in the spin-drying operation, it is possible to prevent abnormal vibrations from occurring.

Also, in the embodiment, when the determination portion 52 determines that laundry C having a waterproofing property is accommodated in the drum 30, an operation of the driving motor 41 is controlled to rotate the drum 30 at or below a certain rotation number in an intermediate spin-drying operation or a final spin-drying operation. However, the present invention is not limited thereto.

For example, when the determination portion 52 determines that the laundry C having a waterproofing property is accommodated in the drum 30, it is possible to control the operation of the driving motor 41 to be stopped to stop the following washing operation. Afterwards, when the user resumes the washing operation, like the above-described sequence, according to the opened or closed state of the cover 11*b* or manipulation of the resuming switch 17, the drum 30 may be rotated at the general rotation number in the spin-drying operation.

Embodiment 3

FIG. 11 is a side cross-sectional view illustrating a configuration of a driving motor mounted on a washing machine according to Embodiment 3 of the present invention.

In the washing machine 10 according to Embodiment 3, the driving motor 41 is configured to be a so-called dual-rotor motor to drive the drum 30 and the pulsator 45 to independently rotate.

In FIG. 11, the driving motor 41 includes an outer rotor (a second rotor) 46, an inner rotor (a first rotor) 47, an inner shaft (a first rotating shaft) 43, an outer shaft (a second rotating shaft) 44, a ring-shaped stator 48, and the like. That is, the driving motor 41 is a so-called dual-rotor motor which includes the outer rotor 46 and the inner rotor 47 in a radially outward direction and a radially inward direction of one stator 48.

Also, since the outer rotor 46 and the inner rotor 47 are connected to the pulsator 45 or the drum 30 not through a clutch, an accelerator/decelerator, or the like, the driving motor 41 is configured to directly drive them.

The outer rotor 46 and the inner rotor 47 share coils of the stator 48 and currents are supplied to the coils such that the driving motor 41 may drive the outer rotor 46 and the inner rotor 47 to independently rotate. The stator 48 is mounted on a bearing bracket 70 installed at a bottom surface of the tub 20.

The outer rotor 46 is a cylindrical member having a flat bottom and includes a bottom wall portion 46*a* having an open central portion, a rotor yoke 46*b* which is vertical and is installed at a circumferential edge of the bottom wall portion 46*a*, and a plurality of outer magnets 46*c* formed of arc-shaped permanent magnets.

The inner rotor 47 is a cylindrical member having a flat bottom with an outer diameter smaller than that of the outer rotor 46 and includes an inner bottom wall portion 47*a* having an open central portion, an inner circumferential wall portion 47*b* which is vertical and is installed around the inner bottom wall portion 47*a*, and a plurality of inner magnets 47*c* formed of rectangular-plate-shaped permanent magnets.

The inner shaft 43 is a cylindrical shaft member and is rotatably supported by the bearing bracket 70 through an inner bearing 73, an outer shaft 44, and ball bearings 71 and 72. A bottom end of the inner shaft 43 is connected to the outer rotor 46. A top end of the inner shaft 43 is connected to the pulsator 45.

The outer shaft 44 is a cylindrical shaft member which is shorter than the inner shaft 43, has an inner diameter greater than an outer diameter of the inner shaft 43 and is rotatably supported by the bearing bracket 70 through upper and lower inner bearings 73, the inner shaft 43, and the ball bearings 71 and 72. A bottom end of the outer shaft 44 is connected to the inner rotor 47. A top end of the outer shaft 44 is connected to the drum 30.

The stator 48 is a circular-ring-shaped member having an outer diameter smaller than an inner diameter of the outer rotor 46 and an inner diameter greater than an outer diameter of the inner rotor 47. The stator 48 is provided such that a plurality of teeth 48*a*, coils, or the like are embedded in a resin.

The above-described driving motor 41 is configured to drive the drum 30 and the pulsator 45 to independently rotate. Accordingly, in the embodiment, when it is determined that the laundry C having a waterproofing property is accommodated in the drum 30, it is controlled to remove water contained in the waterproof clothes C2.

In detail, when the determination portion 52 determines that the laundry C having a waterproofing property is accommodated in the drum 30, the controller 50 controls the operation of the driving motor 41 to independently drive the pulsator 45 and the drum 30 (for example, contrary rotation by independent driving or same phase speed difference rotation and the like) during a washing operation or a rinsing operation performed after a water supply operation. In a following spin-drying operation, driving of the driving motor 41 is controlled to rotate the drum 30 at a general rotation number.

Hereby, water contained in the waterproof clothes C2 may be removed by independent driving of the pulsator 45 and the drum 30 such that occurrence of abnormal vibrations may be prevented during the spin-drying operation even when the drum 30 is rotated at the general rotation number.

However, the water contained in the waterproof clothes C2 may not be completely removed by only independently driving the pulsator 45 and the drum 30. In this case, when the drum 30 is continuously rotated at the general rotation number during the spin-drying operation, abnormal vibrations may occur.

Accordingly, in the embodiment, the operation of the driving motor 41 is adequately controlled on the basis of a detection result of the vibration sensor 36 in the spin-drying operation. In detail, in the spin-drying operation, the controller 50 detects a prelude to abnormal vibrations on the basis of the vibration sensor 36 and controls the driving motor 41 to stop operating.

Also, since the detection of the prelude to abnormal vibrations is identical to that of Embodiment 2, an overlapped description will be omitted.

Also, according to Embodiment 3, the driving motor 41 which includes the outer rotor 46 and the inner rotor 47 is applicable to Embodiments 1 and 2.

Other Embodiments

The above-described embodiments may be configured as follows.

Although a configuration in which a pressure sensor is used as the water level detector 28 has been described in the embodiment, the present invention is not limited thereto. For example, a capacitance sensor, an ultrasonic sensor, an imaging sensor, an optical sensor, a radiowave sensor, a heat sensor, and the like may be used as a water level detector.

Also, the pressure sensor as the water level detector 28 is installed outside the tub 20 in the embodiment but may be installed inside the tub 20.

In addition, the present invention is not limited to each of the above-described embodiments and may be formed by combining components disclosed in the embodiments and may be variously modified without departing from the intent of the present invention.

As described above, since highly utilizable effects in which it is properly determined whether a prelude to abnormal vibrations is present and it is adequately controlled such that abnormal vibrations do not occur during a spin-drying operation, the present invention is very useful and has high industrial applicability.

The invention claimed is:

1. A washing machine comprising:

a tub;

a drum rotatably installed in the tub;

a water supply device configured to supply water to the tub;

a driving portion configured to rotate the drum;

a water level detector configured to detect a water level in the tub; and a controller configured to control the water supply device and the driving portion to perform washing operations including a water supply operation, a drainage operation, and a spin-drying operation, wherein the controller is configured to:

calculate a first water level change rate after start of the water supply operation according to a detection result of the water level detector during the water supply operation, calculate a second water level change rate after the first water level change rate is calculated, determine, based on a ratio of the second water level change rate to the first water level change rate being greater than a predetermined threshold, whether a laundry within the drum includes a waterproof cloth, before performing the spin-drying operation, and control an operation of the driving portion based on the waterproof cloth accommodated in the drum.

2. The washing machine of claim 1, wherein based on the waterproof cloth is accommodated in the drum, the controller is configured to:

stop the operation of the driving portion; or control the operation of the driving portion to rotate the drum at or below a certain rotation number during the spin-drying operation.

3. The washing machine of claim 1, wherein the controller is configured to calculate the first water level change rate when the water level is present between a bottom portion of the tub and a bottom portion of the drum or in an area adjacent thereto.

4. The washing machine of claim 1, further comprising a notification buzzer, a notification display, and a notification transmitter, each of which are configured to perform a certain notification operation in response to a determination that the waterproof cloth is accommodated in the drum.

5. The washing machine of claim 4, wherein the notification transmitter is configured to transmit a result of the determination to an external terminal device having a communication function.

6. The washing machine of claim 1, further comprising a vibration sensor configured to detect vibrations of the tub, wherein the controller is configured to:

control the operation of the driving portion when the water supply operation is consecutively performed, detect a prelude to abnormal vibrations using the vibration sensor when the water supply operation is temporarily stopped, and control the driving portion in the spin-drying operation.

7. The washing machine of claim 1, further comprising:

a cover configured to open or close an inlet, through which the laundry is input or withdrawn;

an opening or closing detector configured to detect an opened state or a closed state of the cover; and a resuming switch configured to resume the washing operations according to a manipulation of a user while the washing operations is stopped, wherein the controller is configured to control the operation of the driving portion to rotate the drum at a general rotation number during the spin-drying operation when the resuming switch is operated after the opening or closing detector detects that the cover is opened and closed.

8. The washing machine of claim 1, further comprising a pulsator connected to the driving portion and configured to stir the laundry, wherein the controller is configured to control the operation of the driving portion to rotate the pulsator at or above a certain rotation number during the washing operations or a rinsing operation performed after the water supply operation based on the waterproof cloth is accommodated in the drum.

9. The washing machine of claim 8, wherein the driving portion comprises a ring-shaped stator and a first rotor and a second rotor, which are rotatable independently from the stator, and wherein one of the first rotor and the second rotor is connected to the drum, and the other of the first rotor and the second rotor is connected to the pulsator.

10. The washing machine of claim 9, further comprising a vibration sensor configured to detect vibrations of the tub, wherein the controller is configured to control the operation of the driving portion by detecting a prelude to abnormal vibrations using the vibration sensor during the spin-drying operation.

* * * * *